US005170570A

United States Patent [19]

Mays, Jr.

[11] Patent Number: 5,170,570

[45] Date of Patent: Dec. 15, 1992

[54] HAND, FINGER AND JOINT MEASURING GAUGE

[76] Inventor: John H. Mays, Jr., 29335 Bates Rd., Perrysburg, Ohio 43551

[21] Appl. No.: 861,000

[22] Filed: Mar. 31, 1992

[51] Int. Cl.[5] ..... A41H 1/02

[52] U.S. Cl. ..... 33/512; 33/474; 33/476; 33/2 R; 33/679.1; 33/555.3; 33/563

[58] Field of Search ..... 33/2 R, 474, 476, 483, 33/494, 511, 512, 679.1, 555.2, 555.3, 562, 563

[56] References Cited

U.S. PATENT DOCUMENTS

| | | | |
|---|---|---|---|
| 3,024 | 3/1843 | Oliver | 33/2 R |
| 181,671 | 8/1876 | Greensfelder . | |
| 1,389,486 | 8/1921 | Brewer | 33/562 |
| 1,981,911 | 11/1934 | Engelsman | 33/512 |
| 2,250,711 | 7/1941 | Johanson | 33/2 R |
| 2,605,548 | 8/1952 | Clarke . | |
| 4,150,488 | 4/1979 | Behnke | 33/567 |
| 4,160,327 | 7/1979 | Martin et al. | 33/2 R |
| 4,173,074 | 11/1979 | Newman et al. | 33/2 R |
| 4,635,370 | 1/1987 | Beaver | 33/679.1 |
| 4,897,924 | 2/1990 | Tepley | 33/2 R |

*Primary Examiner*—William A. Cuchlinski, Jr.
*Assistant Examiner*—Alvin Wirthlin
*Attorney, Agent, or Firm*—Jacobson, Price, Holman & Stern

[57] ABSTRACT

A generally L-shaped gauge is provided including short and long legs disposed at 90 degrees relative to each other with the width of the short leg being generally two-thirds the width of the long leg and with each of the legs having a V-shaped slot formed therein and extending longitudinally thereof, the major width end of each slot opening through the free end of the corresponding leg. The exterior angle side of the long leg includes length indicating indicia extending therealong from the excluded angle side edge of the short leg, the included angle side edge of the long leg includes length indicating indicia spaced therealong from the included angle side edge of the short leg and each of the legs having indicia spaced along the corresponding notch indicating the circumference of a finger digit joint transversely seated in the notch.

7 Claims, 2 Drawing Sheets

HAND, FINGER AND JOINT MEASURING GAUGE

BACKGROUND OF THE INVENTION

1. Field of the Invention

This invention relates to a gauge to be used in measuring various dimensions of the hand of a patient in order to enable custom-made medical compression gloves to be manufactured of the proper size for that patient.

2. Description of Related Art

Various different forms of gauges and measuring devices including some of the general structural and operational features of the instant invention and other measuring devices specifically designed to measure the hand heretofore have been provided. Examples of these previously known devices are disclosed in U.S. Pat. Nos.: 3,024, 181,671, 2,250,711, 2,605,548, 4,173,074 and 4,897,924.

However, these previously known devices do not include the overall combination of structural and operational features of the instant invention which together provide a device which may be used to determine numerous measurements of a hand which are necessary to enable a custom-made medical compression glove to be properly sized for a particular hand.

SUMMARY OF THE INVENTION

The gauge of the instant invention is operable to quickly determine more than 20 different measurements of a hand which are required in order to accurately engineer and manufacture pressure gloves used in the medical field.

These gloves are used to prevent or control hypertrophic scaring and burns on the hands, and to control edema for people who have developed these indications for various reasons including post mastectomy patients.

The hand measurements should be as accurate as possible in order to enable the pressure glove to function properly. To this point, the accepted method for determining the various dimensions of a hand has been through the utilization of a paper tape measure to measure the circumference of each of the joints of the digits. Thereafter, the outline of the hand is drawn and measurements are then taken from the outline to determine the length of each finger and the distance from each web to the top of the wrist. This method of measuring a hand is practiced nationwide and requires about seven minutes time for each hand. Also, this presently used method, inasmuch as the hand is manually traced and measurements are thereafter taken from the traced outline of the hand, is not sufficiently precise to enable a high percentage of properly fitting gloves to be manufactured. Therefore, inasmuch as custom-made medical compression gloves cost between $45 and $60 a piece, the present method of accomplishing the necessary hand measurements results in increases in cost and delays in obtaining properly sized gloves.

It is also pointed that two gloves usually are manufactured for each hand so that one glove may be removed after 23 hours of use each day and the second glove may be reapplied to the hand after a period of approximately one hour without the hand being covered by a glove, the first glove then being cleaned for reuse in another 24 hours. Therefore, if the measurements of a hand are not properly determined before the gloves are manufactured, two gloves are incorrectly manufactured and then must be replaced.

The main object of this invention is to provide a gauge which will enable over 20 measurements of a hand to be accurately made and utilized in the manufacture of properly fitted custom-made medical compression gloves.

Another object of this invention is to provide a gauge which may be used by relatively inexperienced persons to make accurate hand measurements.

Another very important object of this invention is to provide a hand measurement gauge which comprises a single piece gauge, but which may be utilized to determine substantially all hand measurements which are required for the manufacture of properly sized custom-made medical compression gloves.

A final object of this invention to be specifically enumerated herein is to provide a gauge in accordance with the preceding objects and which will conform to conventional forms of manufacture, be of simple construction and easy to use so as to provide a device which will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
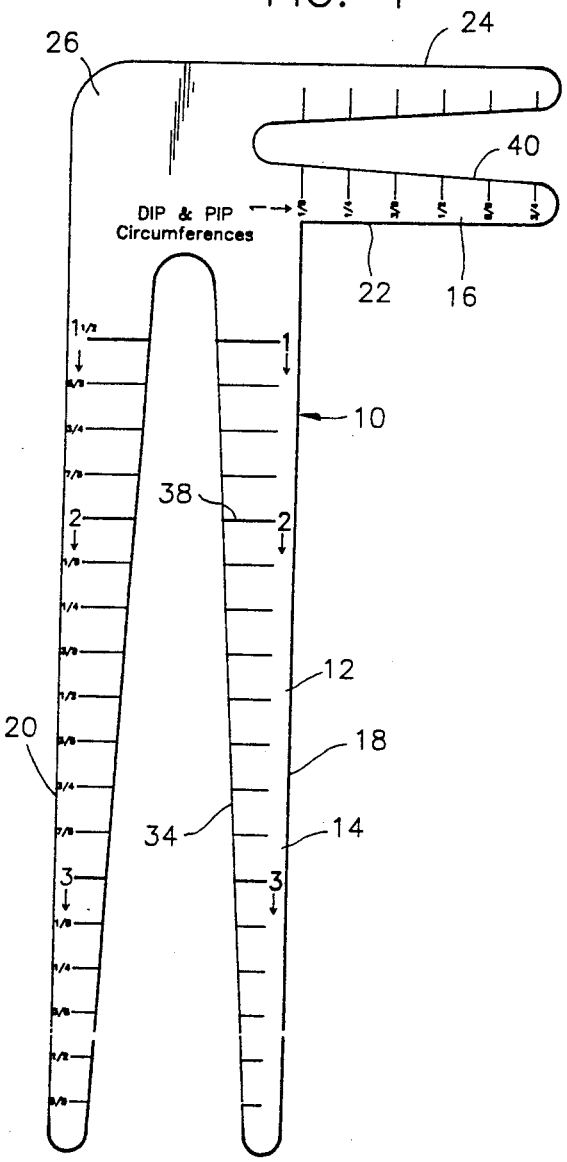
FIG. 1 is a front elevational view of a gauge constructed in accordance with the present invention.
Figure 2:
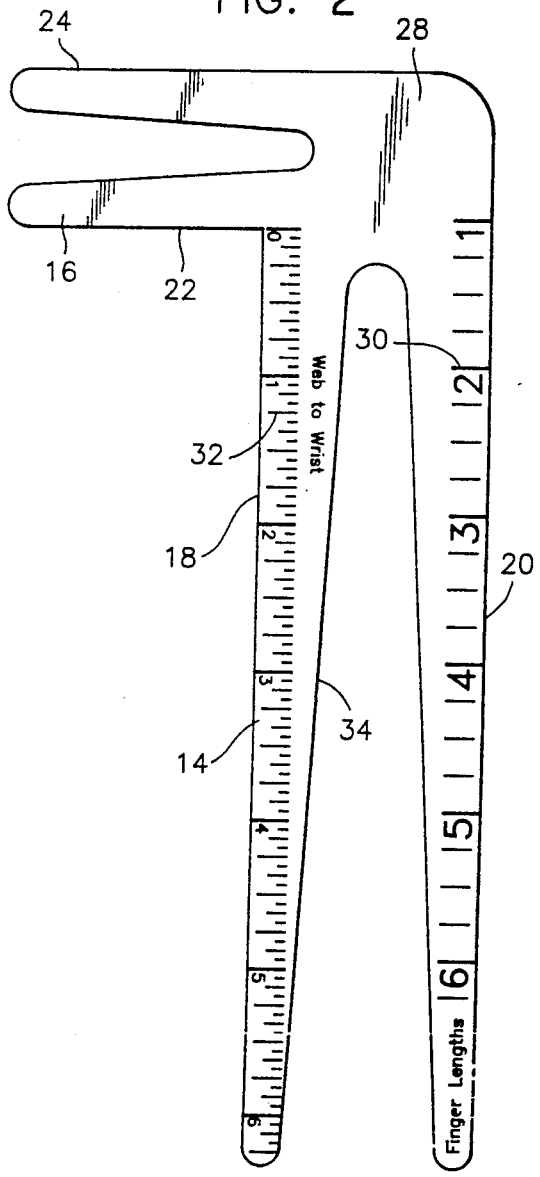
FIG. 2 is a rear elevational view of the gauge.
Figure 3:
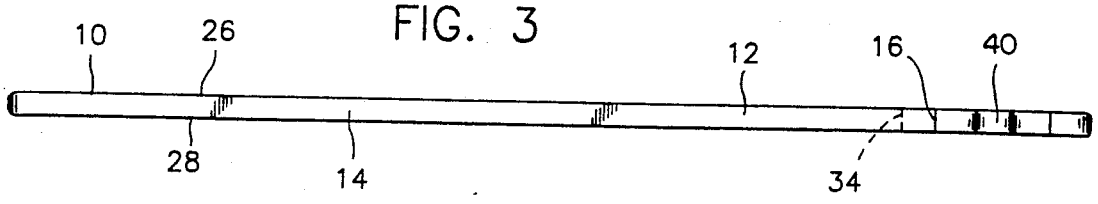
FIG. 3 is a side elevational view of the gauge as seen from the right side of FIG. 1.

Referring now more specifically to the drawings the numeral 10 designates a gauge constructed in accordance with the present invention. The gauge 10 comprises a shape retentive, flat panel 12, generally three millimeters in thickness, including first and second long and short legs 14 and 16 disposed at right angles to each other in the plan of the panel. The long leg includes included and excluded angle longitudinal side edges 18 and 20 which are disposed generally normal to the included and excluded angle longitudinal side edges 22 and 24 of the short leg 16. Further, it will be noted that the longitudinal side edges 18 and 20 of the long leg 14 parallel each other and that the longitudinal side edges 22 and 24 of the short leg 16 also parallel each other.

The panel 12 includes a front side or face 26 and a rear side or face 28. The rear side or face 28 includes first distance scale indicia 30 spaced therealong from the excluded angle side edge 24 of the short leg 16, the indicia 30 being provided to measure finger lengths from either of the adjacent webs to the tip thereof. Also, the included angle side edge 18 of the long leg 14 includes second distance indicia 3 spaced therealong from the included angle side edge 22 of the short leg 16, the indicia 32 being provided to measure the distance between a web of a hand between two adjacent fingers to the associated wrist.

In addition, the long leg 14 includes a V-shaped slot 34 formed therein and extending longitudinally thereof. The slot 34 opens endwise outwardly of the end of the long leg 14 remote from the short leg 16 and the slot 34 is substantially centered relative to the longitudinal center axis of the long leg 14, the apex end of the V-shaped slot 34 being closed and disposed adjacent the short leg 16. Of course, the major dimension end of the slot 34 opens endwise outwardly of the free end of the long leg 34.

On the front side or face 26 of the panel 12, indicia 38 extends along the slot 34. The indicia 38 indicates the circumference of a finger joint according to the width of the joint.

Also, the short leg 16 includes a V-shaped slot 40 formed therein corresponding to the slot 34. However, the slot 40, at its maximum width portion is less than the width of the slot 34 at a point spaced therealong only one-quarter the length thereof from the closed apex end. Further, the width of the short leg 16 is only approximately two-thirds of the width of the long leg 14.

By making the width of the short leg 16 only two-thirds the width of the long leg 14 and having the widest part of the slot 40 less than the width of the slot 34 at point spaced therealong one-quarter the distance from the apex end thereof, the width of those portions of the short leg 16 disposed on opposite sides of the slot 40 is maintained at a minimum in order that these portions may be received between adjacent fingers of a child's hand.

Figure 4:
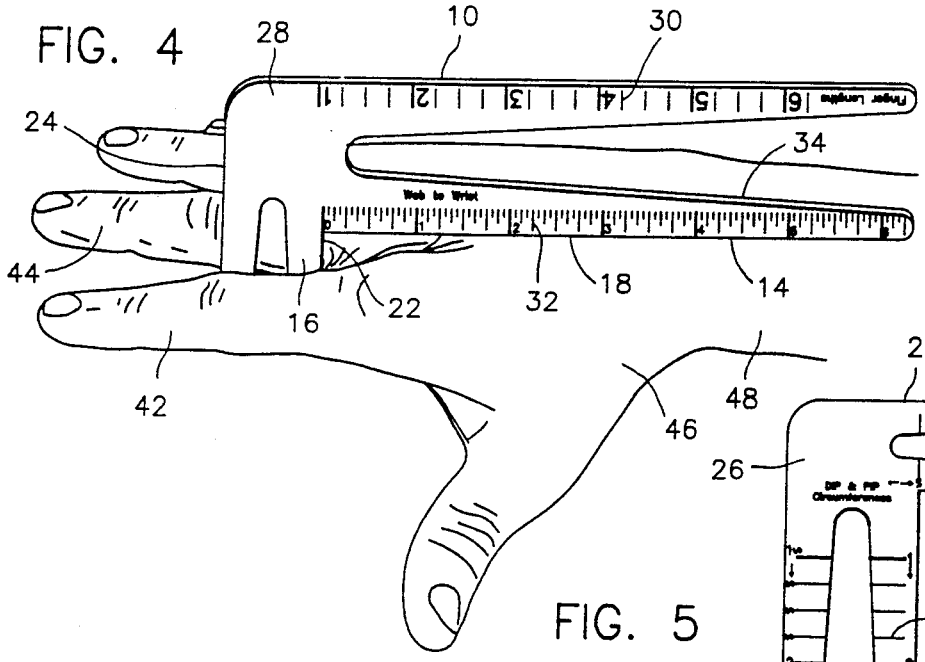
FIG. 4 is a perspective view of the gauge indicating the manner in which a finger web-to-wrist distance may be determined utilizing the gauge.

With attention now invited more specifically to FIG. 4 of the drawings, it may be seen that the gauge 10 is being used to measure the distance between the web disposed between the first and second fingers 42 and 44 of a hand 46 and the associated wrist 48. With the gauge used in this manner four web-to-wrist measurements may be made.

Figure 5:
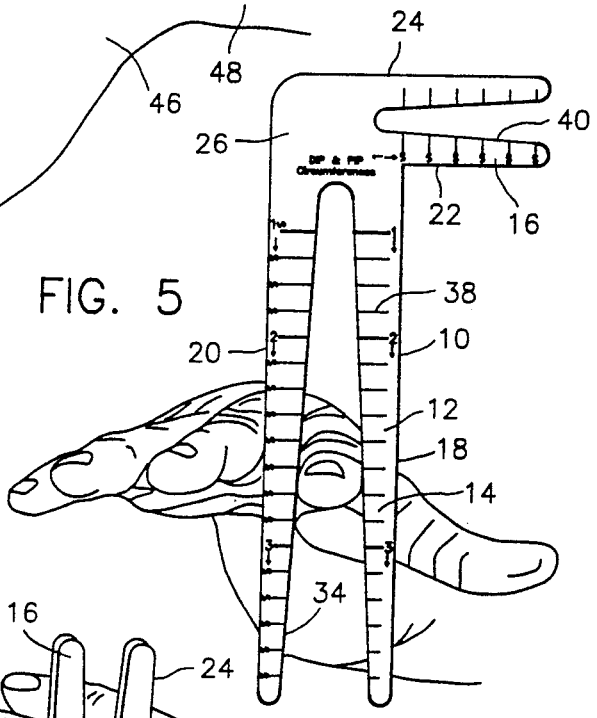
FIG. 5 is a front elevational view of the gauge indicating the manner in which the distal interchanges joint of the forefinger of a hand of an adult may be measured.

With attention now invited more specifically to FIG. 5, the gauge 10 in FIG. 5 is being used to measure the circumference of the distal interphalanges joint of the first finger. The joint is seated in the slot 34 in the manner indicated and, according to the width of the joint seated in the slot 34, the indicia 38 indicates with considerable precision the circumference of the joint. The gauge 10 may be used to make nine joint measurements when used in the manner indicated in FIG. 5.

Figure 6:
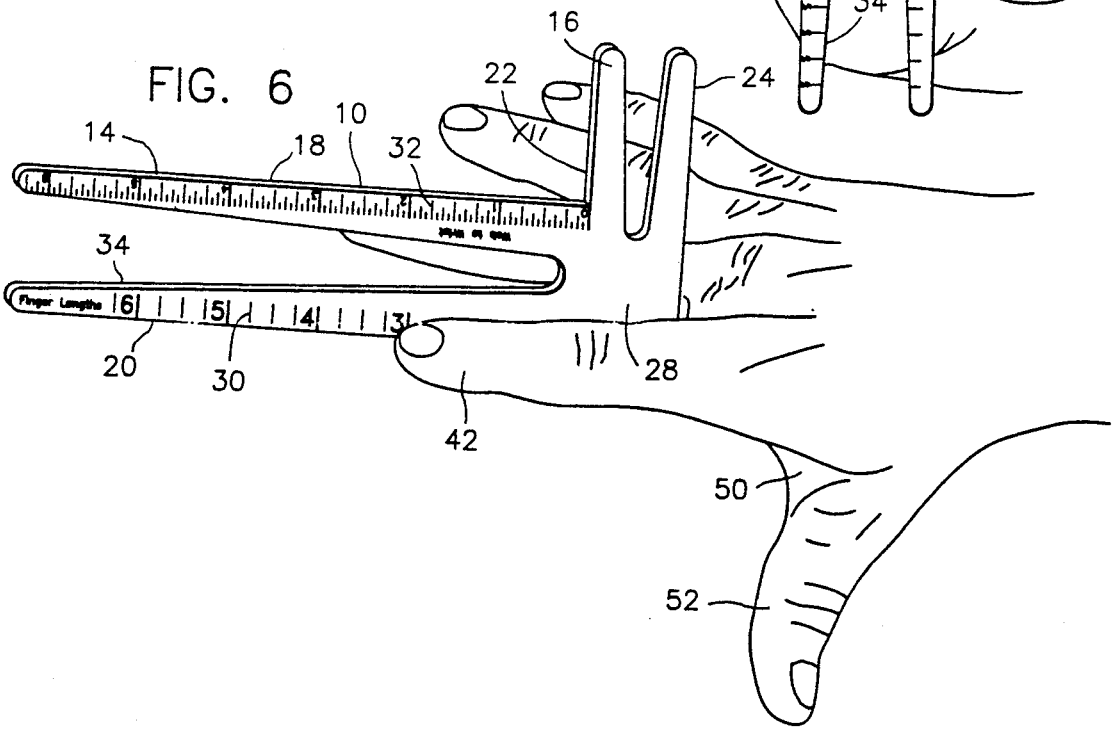
FIG. 6 is a perspective view of the gauge indicating the manner in which the length of the forefinger of a hand may be measured.

With attention now invited to FIG. 6, it may be seen that the gauge 10 is being utilized to measure the length of the fingers from the web of the hand to the fingertip. In this manner, five additional hand measurements may be made as well as a sixth measurement from the web 50 of the thumb 52 to the tip of the first finger 42. Also, the scale indicia 30 may be utilized to measure the width of a hand resting over the gauge 10 and the width of the wrist 48 also may be measured utilizing the indicia 30. Accordingly, it is to be understood that over 20 hand measurements may be quickly made through utilization of the gauge 10.

As hereinbefore set forth, the indicia extending along the V-shaped slot 40 on the short leg 16 may be used to measure digit joint circumferences of the hand of a child.

The foregoing is considered as illustrative only of the principles of the invention. Further, since numerous modifications and changes will readily occur to those skilled in the art, it is not desired t limit the invention to the exact construction and operation shown and described, and accordingly, all suitable modifications and equivalents may be resorted to, falling within the scope of the invention.

What is claimed as new is as follows:

1. A gauge for determining numerous dimensions of a hand preparatory to constructing a compression glove for said hand to prevent and/or control hypertrophic scarring, said gauge comprising a flat panel including first and second long and short legs, respectively, disposed at right angles to each other in the plane of said panel and including corresponding included and excluded angle longitudinal side edges disposed generally normal to each other with said side edges of each leg generally paralleling each other, the excluded angle side edge of said long leg having first distance scale indicia spaced therealong from the excluded angle side edge of said short leg, the included angle side edge of said long leg having second distance scale indicia spaced therealong from the included angle side edge of said short leg, said long leg including a first V-shaped slot formed therein extending longitudinally thereof and opening lengthwise outwardly at its major width end through the end of said long leg remote from said short leg and between the corresponding ends of the side edges of said long leg, said long leg having circumference scale indicia spaced along said slot indicating, according to the width of said slot at a predetermined location therealong, the circumference of a finger joint having a width equal to the width of said slot at said predetermined location.

2. The gauge of claim 1 wherein said short leg includes a second V-shaped slot therein extending longitudinally thereof and opening lengthwise outwardly at, its major width end through the end of said short leg remote from said long leg and between the corresponding ends of the side edges of said short leg, said short leg having second circumference scale therealong indicating, according to the width of said second slot at a predetermined location therealong, the circumference of a finger joint having a width equal to the width of said second slot at said predetermined location therealong, the width of said second slot at the end of said short leg remote from said long leg being less than the width of the first slot at point therealong spaced only one-quarter of the length of said first slot from the apex end thereof.

3. The gauge of claim 2 wherein the width of said short leg is generally two-thirds the width of said long leg.

4. The gauge of claim 3 wherein the thickness of said panel is generally three millimeters.

5. The gauge of claim 1 wherein said V-shaped slot is substantially centered between the side edges of said long leg.

6. The gauge of claim 5 wherein said short leg includes a second V-shaped slot therein extending longitudinally thereof and opening lengthwise outwardly at its major width end through the end of said short leg remote from said long leg and between the corresponding ends of the side edges of said short leg, said short leg having second circumference scale indicia spaced therealong indicating, according to the width of said second slot at a predetermined location therealong, the circumference of a finger joint having a width equal to the width of said second slot at said predetermined location therealong, the width of said second slot at the end of said short leg remote from said long leg being less than the width of the first slot at a point therealong spaced only one-quarter of the length of said first slot from the apex end thereof, said second V-shaped slot being substantially centered between the side edges of said short leg.

7. The gauge of claim 6 wherein the width of said short leg is generally two-thirds the width of said long leg.

* * * * *